US005765603A

United States Patent [19]

Healy

[11] Patent Number: 5,765,603

[45] Date of Patent: Jun. 16, 1998

[54] MONITORING FUEL VAPOR FLOW IN VAPOR RECOVERY SYSTEM

[75] Inventor: James W. Healy, Hollis, N.H.

[73] Assignee: Healy Systems, Inc., Hudson, N.H.

[21] Appl. No.: 818,259

[22] Filed: Mar. 14, 1997

[51] Int. Cl.[6] ..... B67D 5/378

[52] U.S. Cl. ..... 141/59; 141/95; 141/7; 137/587

[58] Field of Search ..... 141/5, 7, 45, 59, 141/95, 290; 137/587

[56] References Cited

U.S. PATENT DOCUMENTS

| | | | |
|---|---|---|---|
| 3,926,230 | 12/1975 | Stary et al. | 141/45 |
| 3,955,070 | 5/1976 | Suzuki et al. | 235/92 |
| 3,983,913 | 10/1976 | Bower | 141/95 |
| 4,072,934 | 2/1978 | Hiller et al. | 340/243 |
| 4,100,758 | 7/1978 | Mayer | 141/45 |
| 4,197,883 | 4/1980 | Mayer | 141/59 |
| 5,038,838 | 8/1991 | Bergamini et al. | 141/59 |
| 5,146,902 | 9/1992 | Cook et al. | 123/518 |
| 5,156,199 | 10/1992 | Hartsell, Jr. et al. | 141/83 |
| 5,269,353 | 12/1993 | Nanaji et al. | 141/59 |
| 5,275,144 | 1/1994 | Gross | 123/520 |
| 5,305,807 | 4/1994 | Healy | 141/59 |
| 5,316,057 | 5/1994 | Hasselmann | 141/94 |
| 5,332,008 | 7/1994 | Todd et al. | 141/5 |
| 5,345,979 | 9/1994 | Tucker et al. | 141/1 |
| 5,411,004 | 5/1995 | Busato et al. | 123/520 |
| 5,417,256 | 5/1995 | Hartsell, Jr. et al. | 141/7 |
| 5,429,159 | 7/1995 | Tees et al. | 141/59 |
| 5,450,883 | 9/1995 | Payne et al. | 141/59 |
| 5,651,400 | 7/1997 | Corts et al. | 141/59 |

*Primary Examiner*—J. Casimer Jacyna
*Attorney, Agent, or Firm*—Fish & Richardson P.C.

[57] ABSTRACT

A vapor recovery system monitoring system includes a vacuum monitor and a vent sensor. The vacuum monitor has a signal relay in communication with a vacuum system served by a vacuum source to generate a first signal upon actuation of the vacuum source for recovery of displaced fuel vapor and a second signal when a minimum vacuum level is achieved; a timer measuring elapsed time between first and second signal; a comparator comparing elapsed time with a predetermined standard; and an error display actuated when the predetermined number of instances of elapsed time is exceeded. The vent sensor, mounted to a vent conduit for an underground storage tank, defines an orifice creating a pressure differential when volume flow of vent emission exceeds a predetermined level; a pressure differential switch; a counter receiving a signal from the pressure differential switch for indication of venting frequency over a predetermined time period; a timer receiving a signal from the pressure differential switch for indication of total venting time over a predetermined time period; a comparator comparing total venting time with a predetermined acceptable total venting time; and an error message display actuated when a predetermined acceptable total venting time is exceeded. A method for monitoring a vapor recovery system is also described.

36 Claims, 14 Drawing Sheets

MONITORING FUEL VAPOR FLOW IN VAPOR RECOVERY SYSTEM

BACKGROUND OF THE INVENTION

The invention relates to a system and method for monitoring flow of fuel vapor in a vapor recovery system, e.g. for a motor vehicle fueling station.

Environmental protection regulations require that motor vehicle fueling stations employ one or more systems for recovery of fuel vapor displaced from a motor vehicle fuel tank by liquid fuel delivered into the tank. One presently preferred system employs a vacuum system having a inlet in the portion of the fuel delivery nozzle inserted into the fuel tank spout. Efficient recovery of displaced vapor requires a balance of vacuum recovery volume with liquid fuel delivery volume, which is difficult to maintain in the field, e.g. due to variations in equipment performance, maintenance, etc.

Gasoline vapor recovery during the refueling of motor vehicles has evolved from passive recapture, as exemplified by the booted gasoline dispensing nozzles, commonly referred to as the "balance system", to active bootless gasoline dispensing nozzles, commonly referred to as "vacuum assist". The balance type of nozzle is designed to make a positive seal at the motor vehicle fillpipe, thus channeling the vapor forced out by the incoming liquid to be confined within a vapor pathway from nozzle boot through hose to the dispenser, and then on through underground piping to the ullage space of the service station gasoline holding tanks. This recapture method requires a good seal at the vehicle fillpipe to insure that vapor will be returned to the underground storage tank to replace the liquid dispensed, thus maintaining system "balance". In the real world of vehicle refueling, perfect sealing at the fillpipe is rarely achieved, and the vapor volume lost at the boot-to-fillpipe interface will not reach the underground tanks, therefore causing air to be inbreathed through the tank vent piping. Vapor recovery efficiency for such systems is recognized to be approximately 80 to 85% if good enforcement is practiced.

The bootless vacuum assist technology does not have the basic simplicity of vapor flow control inherent in the balance system. Since the bootless nozzle is, by definition, not sealed at the vehicle fillpipe, some intelligent control must be employed to insure than an essentially equal volume of vapor is extracted from the fillpipe at the same rate as liquid is dispensed. Various methods have been used to produce this end result, including variable-speed pumps paced by electronic signals from the liquid meter; variable position solenoid valves driven by electronic signals referenced to the liquid meter pulsed output in combination with a dedicated vacuum source; and, finally, variable orifice flow controllers that adjust the orifice size in response to liquid flow directly through mechanical means, in combination with dedicated vacuum source for each hose or a central vacuum with a dedicated vacuum regulator for each nozzle.

In all of these vacuum assist concepts, it is possible to have mechanical or electrical problems which can cause the system to pump too much or too little vapor, thus causing the venting of vapor from, or the ingestion of air into, the underground storage tanks. Both conditions result in the loss of vapor recovery efficiency. For example, if the vacuum pump is running, but the vanes and rotor are not working, the vapor expelled from the motor vehicle tank during refueling goes into the atmosphere at the fillneck opening, and pure air is ingested via the tank vent to the underground tank, thus promoting evaporation and future vent losses. At the opposite end of the failure mode possibilities is a system which extracts excess vapor volume from the vehicle fillpipe or develops a leak in the vacuum piping. In either case, the excess volume returned to the underground tank will cause vapor emissions from the tank vent, thus reducing system vapor recovery efficiency.

The venting of vapors from the underground tanks might also be the result of barometric pressure drop or a vacuum system leak or vapor/liquid ratios that are set too high. The barometric pressure drop is an occasional event, and typically does not exceed 12 to 24 hours, therefore venting in excess of 10 hours in one day, or even two days, is expected.

Systems for monitoring and testing the level of performance of fuel vapor recovery systems are described, e.g., in Payne et al. U.S. Pat. No. 5,450,883; Hasselmann U.S. Pat. No. 5,316,057; Hiller et al. U.S. Pat. No. 4,072,934; and Bower U.S. Pat. No. 3,983,913.

SUMMARY OF THE INVENTION

According to one aspect of the invention, a vapor recovery system monitoring system comprises a vacuum monitoring assembly and a vent sensor assembly. The vacuum monitoring assembly comprises a vacuum source signal relay in communication with a vacuum system served by a vacuum source and adapted to generate a first vacuum signal upon actuation of the vacuum source for recovery of displaced fuel vapor and a second vacuum signal when a predetermined minimum vacuum level is achieved in the vacuum system; a timer for measuring the elapsed time between the first vacuum signal and the second vacuum signal; a vacuum comparator for comparing the elapsed time with a predetermined standard; and a vacuum signal device for display of a vacuum error message when a predetermined number of instances of elapsed time exceeding the predetermined standard. The vent sensor assembly comprises a vent sensor mounted to a vent conduit for an underground storage tank, the vent sensor defining an orifice adapted to create a pressure differential when volume flow of vent emissions exceeds a predetermined level; a pressure differential switch; a counter adapted to receive a venting signal from the pressure differential switch for providing indication of venting frequency over a predetermined period of time; a timer adapted to receive a venting signal from the pressure differential switch for providing indication of total venting time over a predetermined period of time; a venting comparator for comparing the total venting time with a predetermined acceptable total venting time; and a venting signal device for display of a venting error message when a predetermined acceptable total venting time is exceeded.

Preferred embodiments of this aspect of the invention may include one or more of the following additional features. The predetermined minimum vacuum level for issue of the second vacuum signal is about −65 inches WC. The vacuum signal device is adapted to display the vacuum error message after a predetermined number of consecutive instances of elapsed time exceeding the predetermined standard, preferably after three consecutive instances of elapsed time exceeding the predetermined standard, preferably ten seconds. The vacuum error message is a flashing signal light and/or an audible signal. The predetermined level of volume flow of vent emissions is about 0.5 gpm (gallons per minute). The venting signal device is adapted to display the venting error message after a predetermined number of consecutive days of total venting time exceeding the predetermined acceptable total venting time, preferably three consecutive days of total venting time exceeding the predetermined acceptable total venting time, preferably ten hours in a twenty-four hour period. The venting error message is a flashing signal light and/or an audible signal. The vapor recovery system monitoring system further comprises a second vent sensor mounted to a vent conduit for an underground storage tank for detection of ingestion of air into the storage tank, the second vent sensor defining an orifice to create a pressure differential whenever vent ingestion volume exceeds a predetermined level, the second vent sensor comprising a second pressure differential switch; a counter adapted to receive a vent ingestion signal from the second pressure differential switch for providing indication of vent ingestion frequency over a predetermined period of time; a timer adapted to receive a vent ingestion signal from the second pressure differential switch for providing indication of total vent ingestion time over a predetermined period of time; a vent ingestion comparator for comparing the total vent ingestion time with a predetermined acceptable total vent ingestion time; and a vent ingestion signal device for display of a vent ingestion error message when a predetermined acceptable total vent ingestion time is exceeded. The vent ingestion signal device is adapted to display the vent ingestion error message after a predetermined number of consecutive days of total vent ingestion time exceeding the predetermined acceptable total vent ingestion time, preferably three consecutive days of total vent ingestion time exceeding the predetermined acceptable total vent ingestion time, preferably ten hours in a twenty-four hour period. The vent ingestion error message is a flashing signal light and/or an audible signal. The vent monitor assembly further comprises a higher pressure P/V valve mounted in parallel. The vapor recovery system monitoring system further comprises a recording device for creating a permanent record of performance. The vent sensor assembly comprises a pressure differential transmitter for calculation of vented volume and/or ingested volume.

According to another aspect of the invention, a method for monitoring a vapor recovery system comprises the steps of providing a vacuum monitoring assembly comprising a vacuum source signal relay disposed in communication with a vacuum system served by a vacuum source; causing the vacuum source signal relay to generate a first vacuum signal upon actuation of the vacuum source for recovery of displaced fuel vapor; causing the vacuum source signal relay to generate a second vacuum signal when a predetermined minimum vacuum level is achieved in the vacuum system; measuring the elapsed time between the first vacuum signal and the second vacuum signal; comparing the elapsed time with a predetermined standard; and displaying a vacuum error message after a predetermined number of instances of elapsed time exceeding the predetermined standard; providing a vent sensor assembly comprising a vent sensor mounted to a vent conduit for an underground storage tank, the vent sensor defining an orifice adapted to create a pressure differential when volume flow of vent emissions exceeds a predetermined level and a pressure differential switch; causing the pressure differential switch to issue a venting signal to a counter for providing indication of venting frequency over a predetermined period of time; causing the pressure differential switch to issue a venting signal to a timer providing indication of total venting time over a predetermined period of time; comparing the total venting time with a predetermined acceptable total venting time; and displaying a venting error message when a predetermined acceptable total venting time is exceeded.

Preferred embodiments of this aspect of the invention may include one or more of the following additional features. The method comprises the further step of displaying the vacuum error message after a predetermined number of consecutive instances of elapsed time exceeding the predetermined standard, preferably after three consecutive instances. The method comprises the further step of displaying the venting error message after a predetermined number of consecutive days of total venting time exceeding the predetermined acceptable total venting time, preferably after three consecutive days. The method comprises the further step of providing a second vent sensor mounted to a vent conduit for an underground storage tank for detection of ingestion of air into the storage tank, the second vent sensor defining an orifice to create a pressure differential whenever vent ingestion volume exceeds a predetermined level and a second pressure differential switch; causing the second pressure differential switch to issue a vent ingestion signal to a counter for providing indication of vent ingestion frequency over a predetermined period of time; causing the second pressure differential switch to issue a vent ingestion signal to a timer for providing indication of total vent ingestion time over a predetermined period of time; comparing the total vent ingestion time with a predetermined acceptable total vent ingestion time; and displaying a vent ingestion error message when a predetermined acceptable total vent ingestion time is exceeded. The method comprises the further step of displaying the vent ingestion error message after a predetermined number of consecutive days of total vent ingestion time exceeding the predetermined acceptable total vent ingestion time, preferably after three consecutive days. The method comprises the further step of creating a permanent record of performance. The method comprises the further step of calculating vented volume and/or ingested volume.

Further according to the invention, a vent monitoring system includes a "vacuum on" signal relay that generates a signal upon actuation of the vacuum pump for recovery of displaced fuel vapor, and a second signal when a predetermined minimum vacuum level, e.g. −65 inches WC, is achieved in the vacuum system. The elapsed time between signals is then compared to a standard, e.g. ten seconds. If the required standard is not met for three consecutive vacuum motor operations, an error message is created, e.g. a flashing signal light on the cabinet and an audible signal to the operator.

The vent monitoring system also includes a vent sensor mounted to the underground storage tank(s). In one preferred embodiment, the vent sensor has a simple orifice to create a pressure differential whenever the volume of a vent emission exceeds a predetermined level, e.g. 0.5 gpm (gallons per minute). The pressure differential switch generates a signal to a counter, and also to a timer, to provide indication of venting frequency and total venting time for each 24 hour period. When a predetermined acceptable total venting time is exceeded, e.g. ten hours, for three consecutive days, an error message is created, e.g. a flashing signal light on the cabinet and an audible signal to the operator.

The vent monitoring system may also include a second vent sensor mounted to underground storage tank(s) for detection of ingestion of air into the storage tank(s). Again, the second vent sensor has a simple orifice to create a pressure differential whenever the volume of a vent ingestion exceeds a predetermined (different) level. The pressure differential switch generates a second signal to a counter, and also to a timer, to provide indication of ingestion frequency and total time for each 24 hour period. As above, when a predetermined acceptable total ingestion time is exceeded, an error message is created, e.g., again, a flashing signal light on the cabinet and an audible signal to the operator.

In each instance, due to the limited flow permitted through the vent sensor, a second, higher pressure P/V valve is also provided to protect the storage tanks.

The system of the invention also may include a recording device for creating a permanent record of performance, e.g. for use by a responsible environmental enforcement authority.

In preferred embodiments, the vent sensor may include a pressure differential transmitter in place of a switch, to permit calculation of vented and/or ingested volume.

These and other features and advantages of the invention will be apparent from the following description of a presently preferred embodiment, and from the claims.

BRIEF DESCRIPTION OF THE DRAWING

FIG. 1 is a somewhat diagrammatic view of a vapor recovery system monitoring system of the invention, while

FIG. 2 is an elementary wiring diagram for one embodiment of a vapor recovery system monitoring system of the invention, while

FIG. 3 is an elementary wiring diagram for another embodiment of a vapor recovery system monitoring system of the invention, while

FIG. 4 is an elementary wiring diagram for another embodiment of a vapor recovery system monitoring system of the invention, while

FIG. 5 is an elementary wiring diagram for another embodiment of a vapor recovery system monitoring system of the invention, while

DESCRIPTION OF THE PREFERRED EMBODIMENTS

Figure 1:
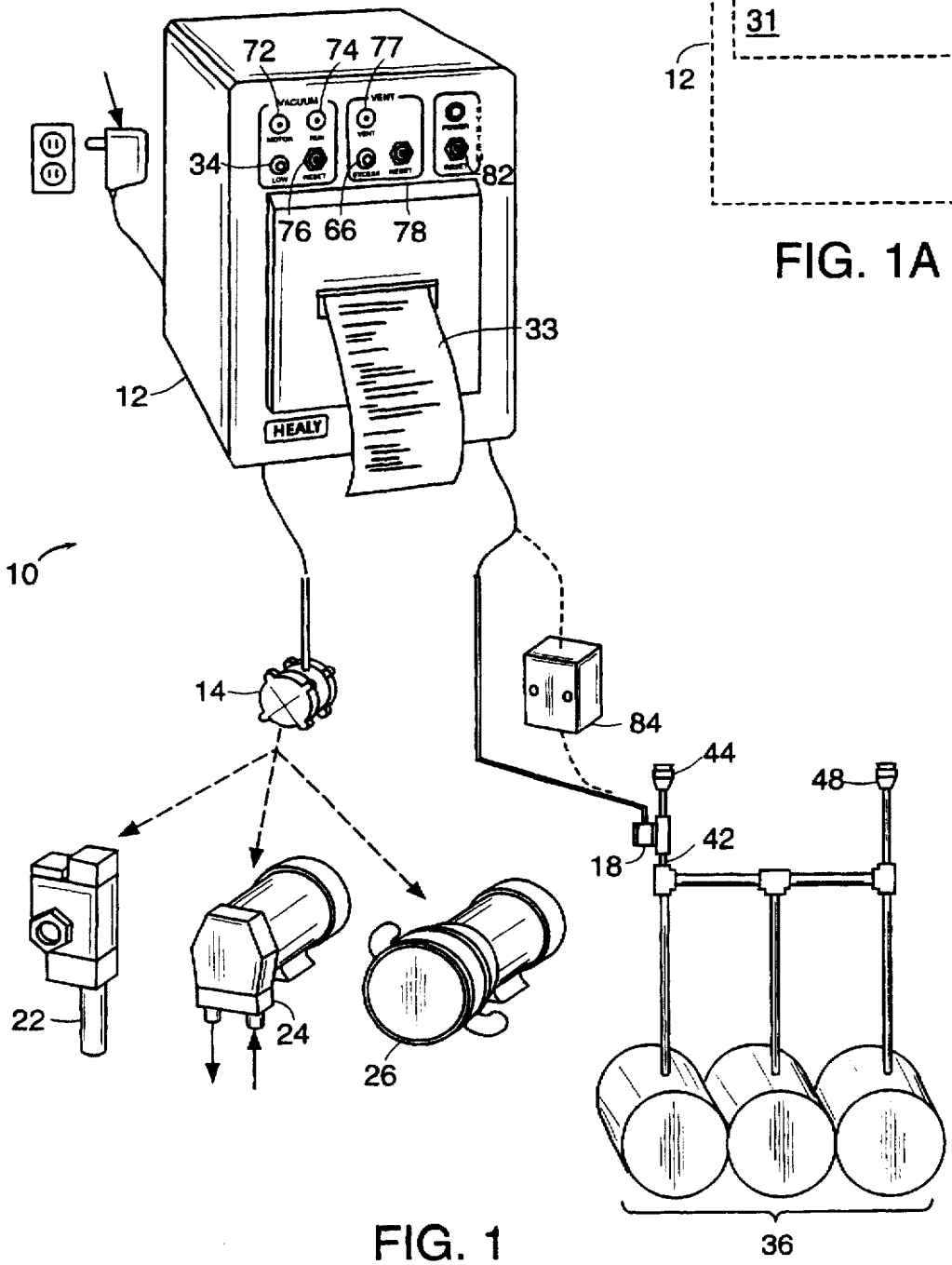
Figure 1A:
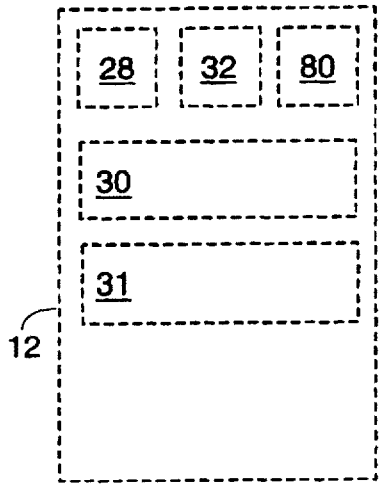
FIG. 1A is a block diagram of monitor components.

Referring to FIG. 1, a vapor recovery system monitoring system 10 of the invention includes a vapor recovery system monitor 12, a pressure-sensing switch 14, a signal relay 16 (FIG. 2), and a vent sensor 18.

The basic functions to be monitored by the vapor recovery system monitoring system 10 of the invention include: vacuum level (for proper vapor recovery) and vent activity.

The vacuum level is detected by pressure-sensing switch 14, which is adjusted to provide switch closure at the predetermined minimum vacuum level required for acceptable vapor recovery efficiency. The operating parameters measured include: time of vacuum motor operation, the maximum allowable time from vacuum motor start-up to switch closure at minimum vacuum level, and time at (or above) minimum operating vacuum level.

Figure 2:
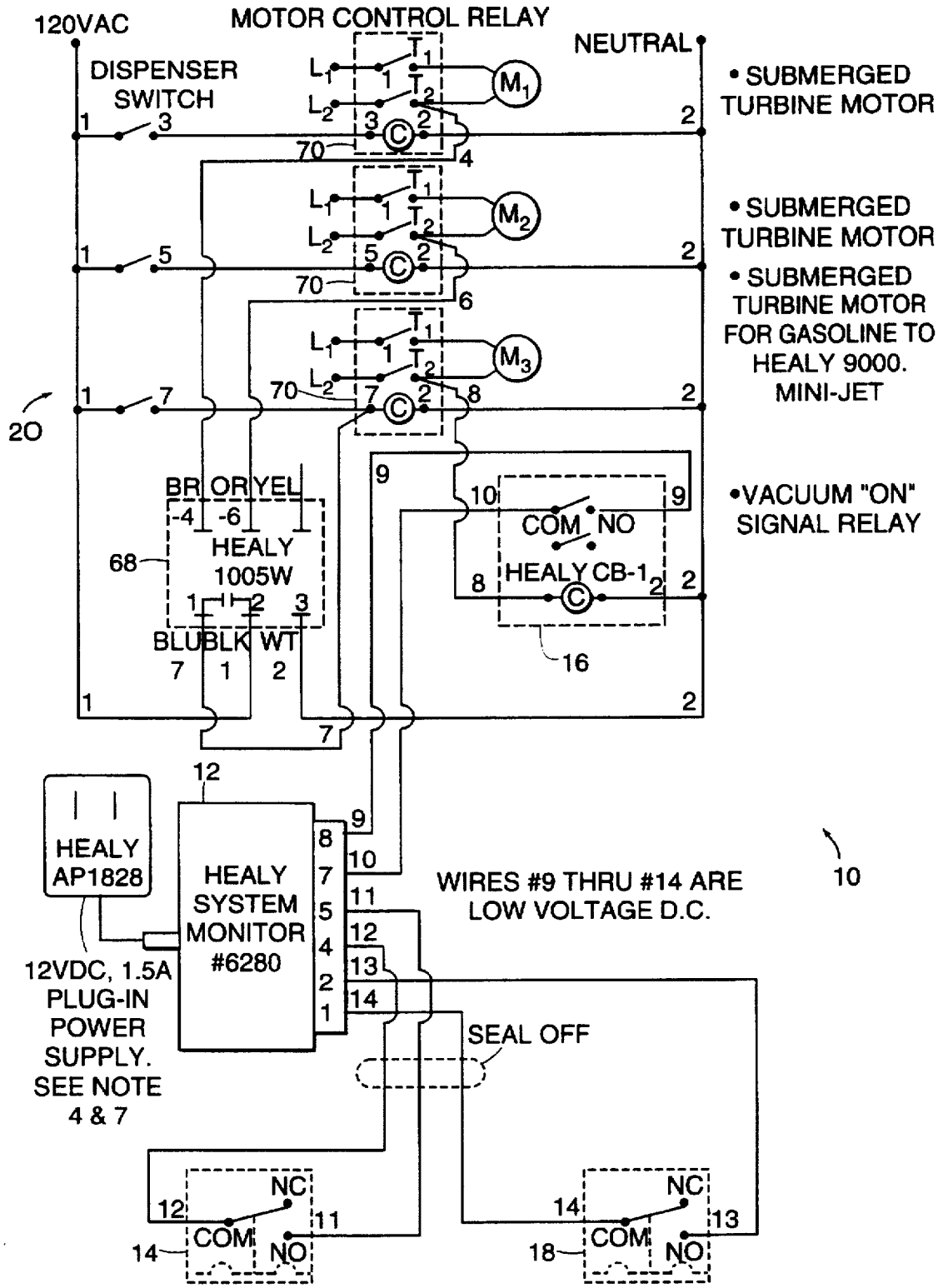
Figure 2A:
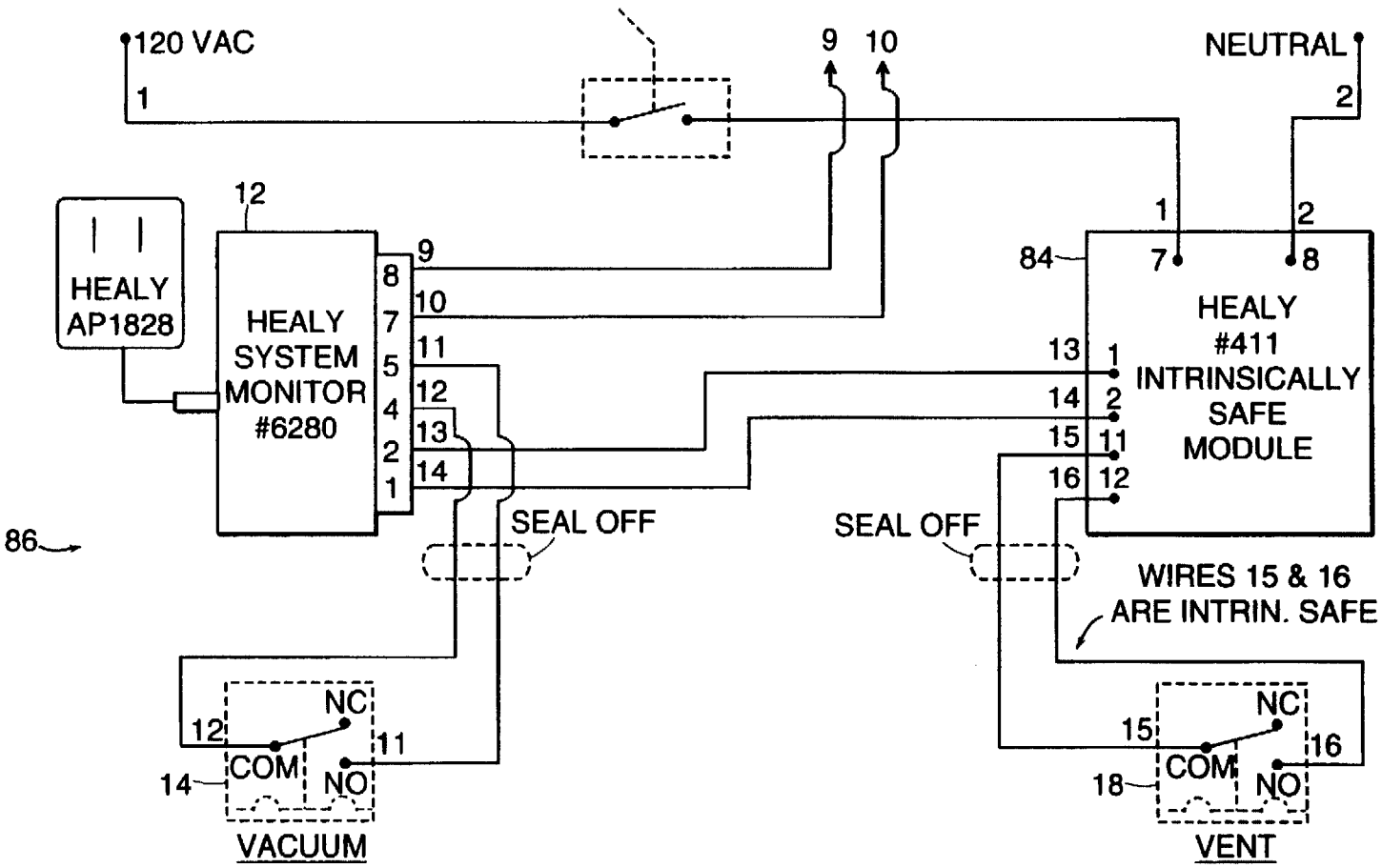
FIG. 2A is a corresponding elementary schematic wiring diagram for optional intrinsically safe wiring.
Figure 3:
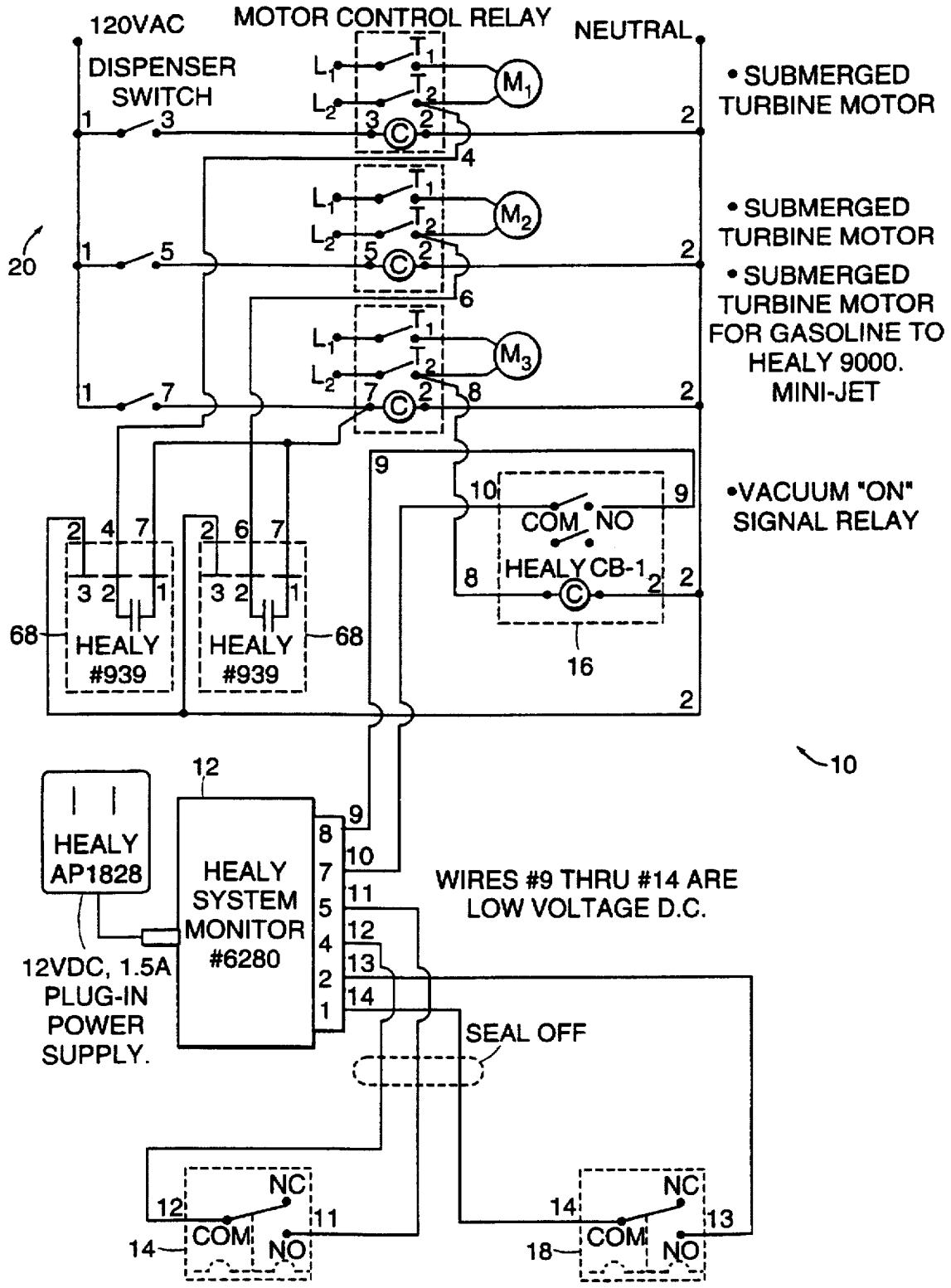
Figure 3A:
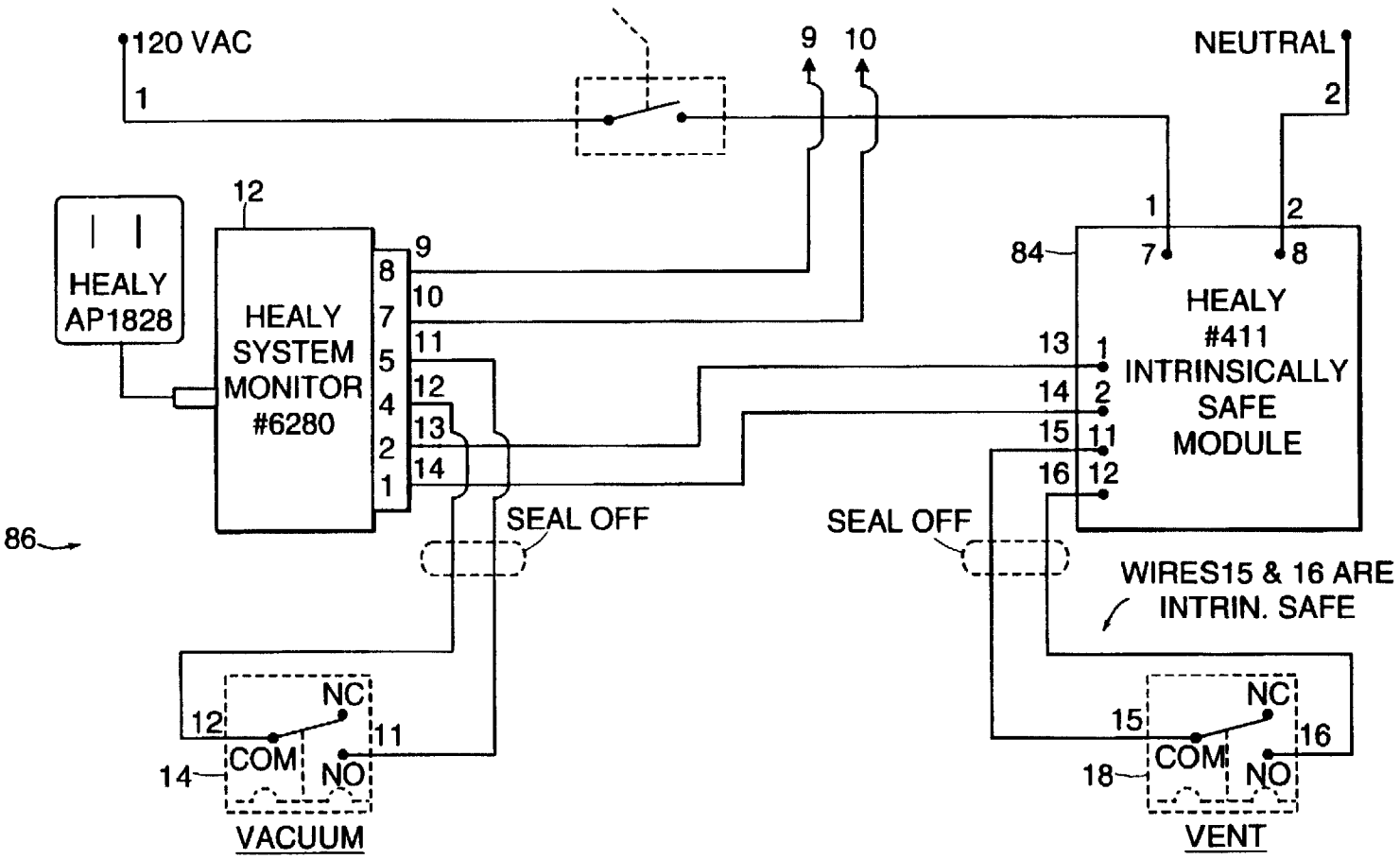
FIG. 3A is a corresponding elementary schematic wiring diagram for optional intrinsically safe wiring.
Figure 4:
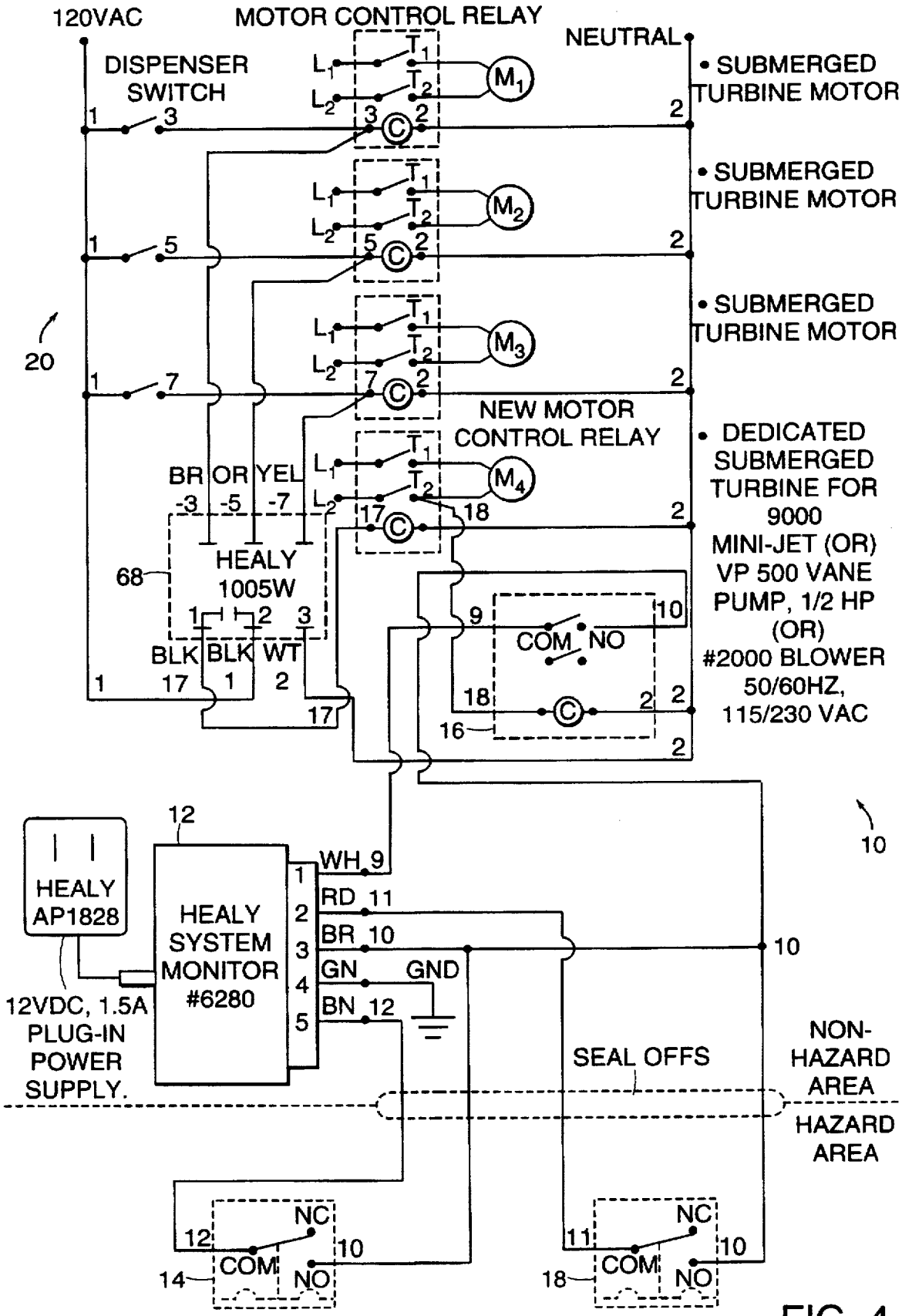
Figure 4A:
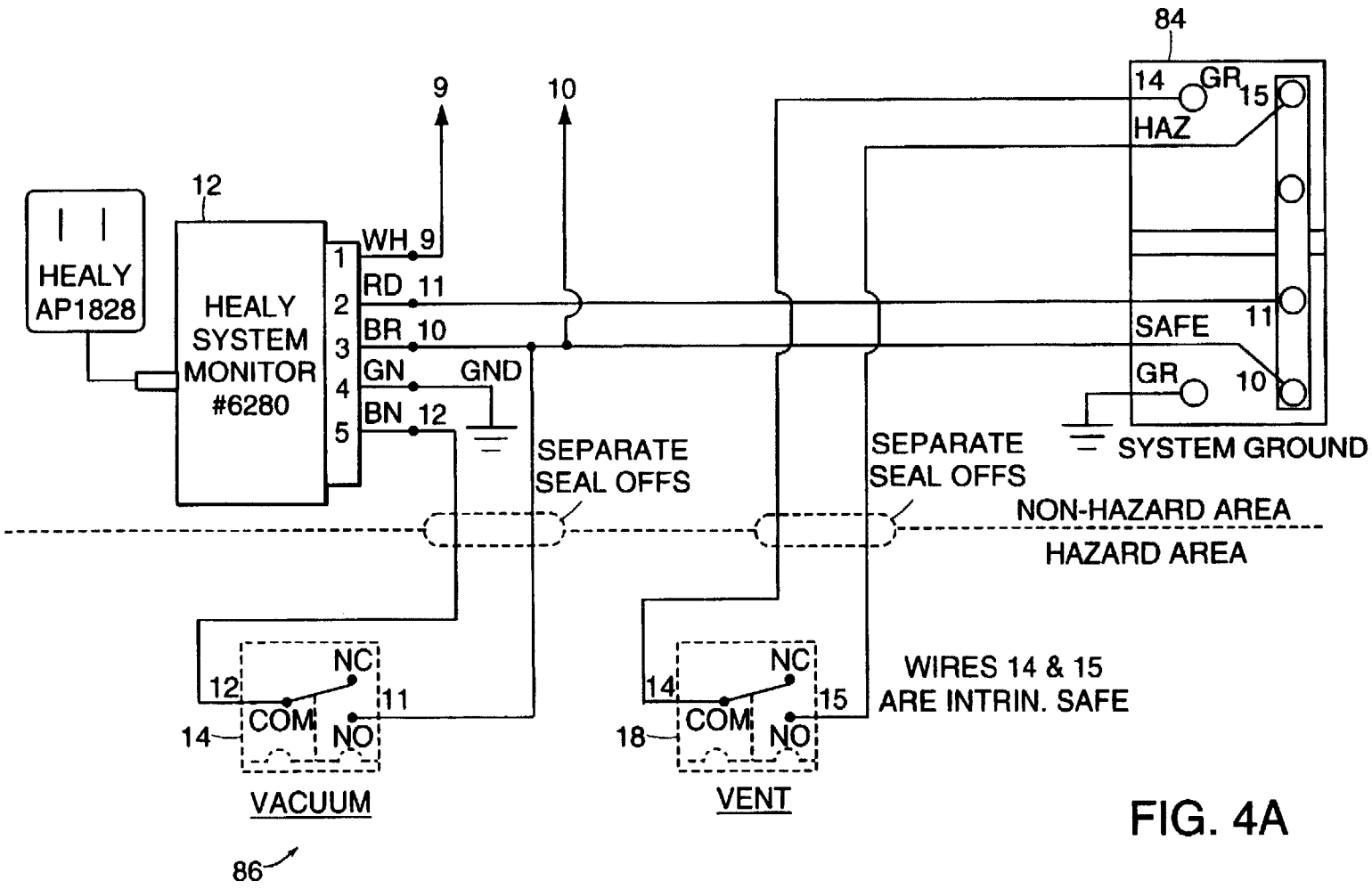
FIG. 4A is a corresponding elementary schematic wiring diagram for optional intrinsically safe wiring.
Figure 5:
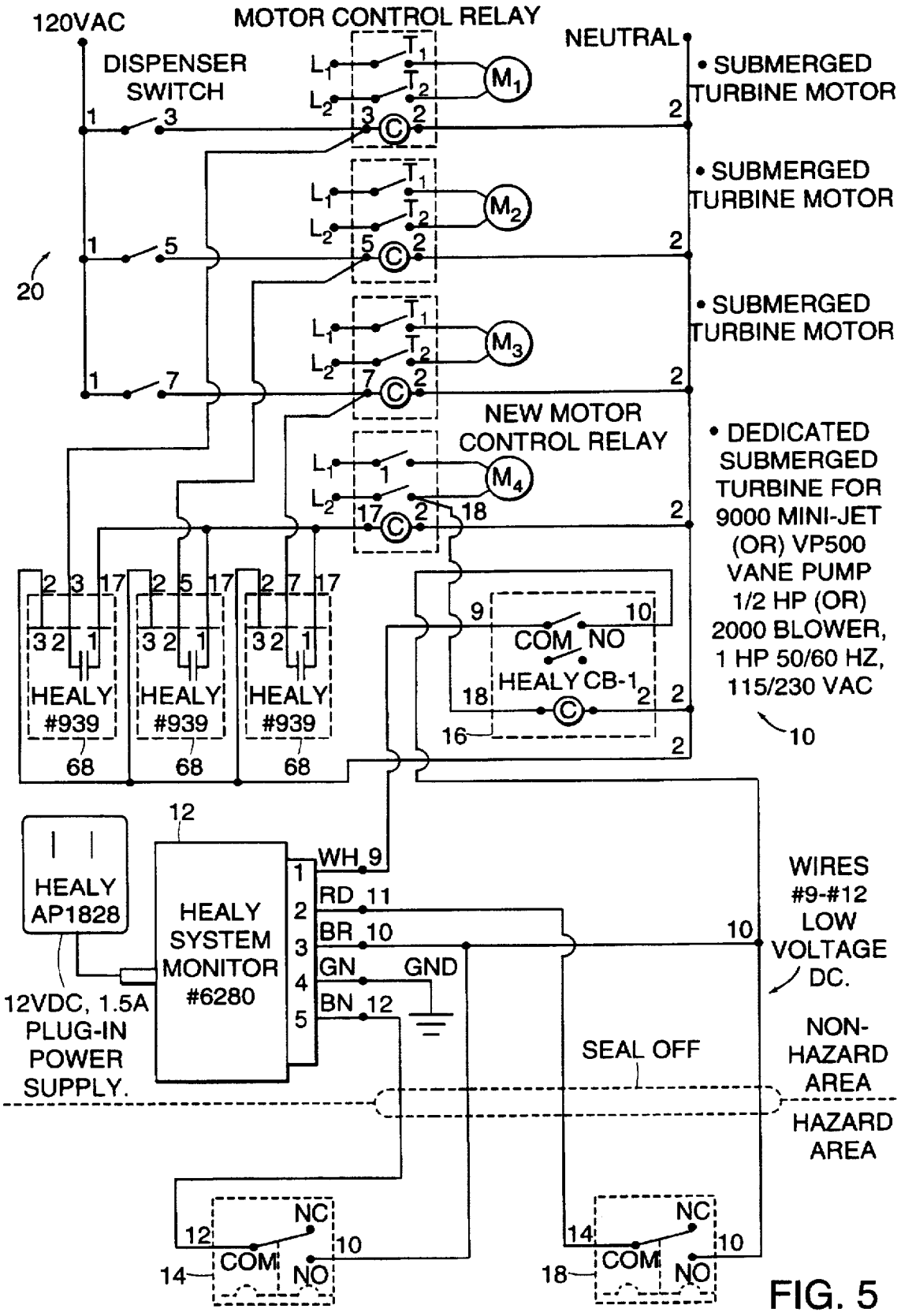
Figure 5A:
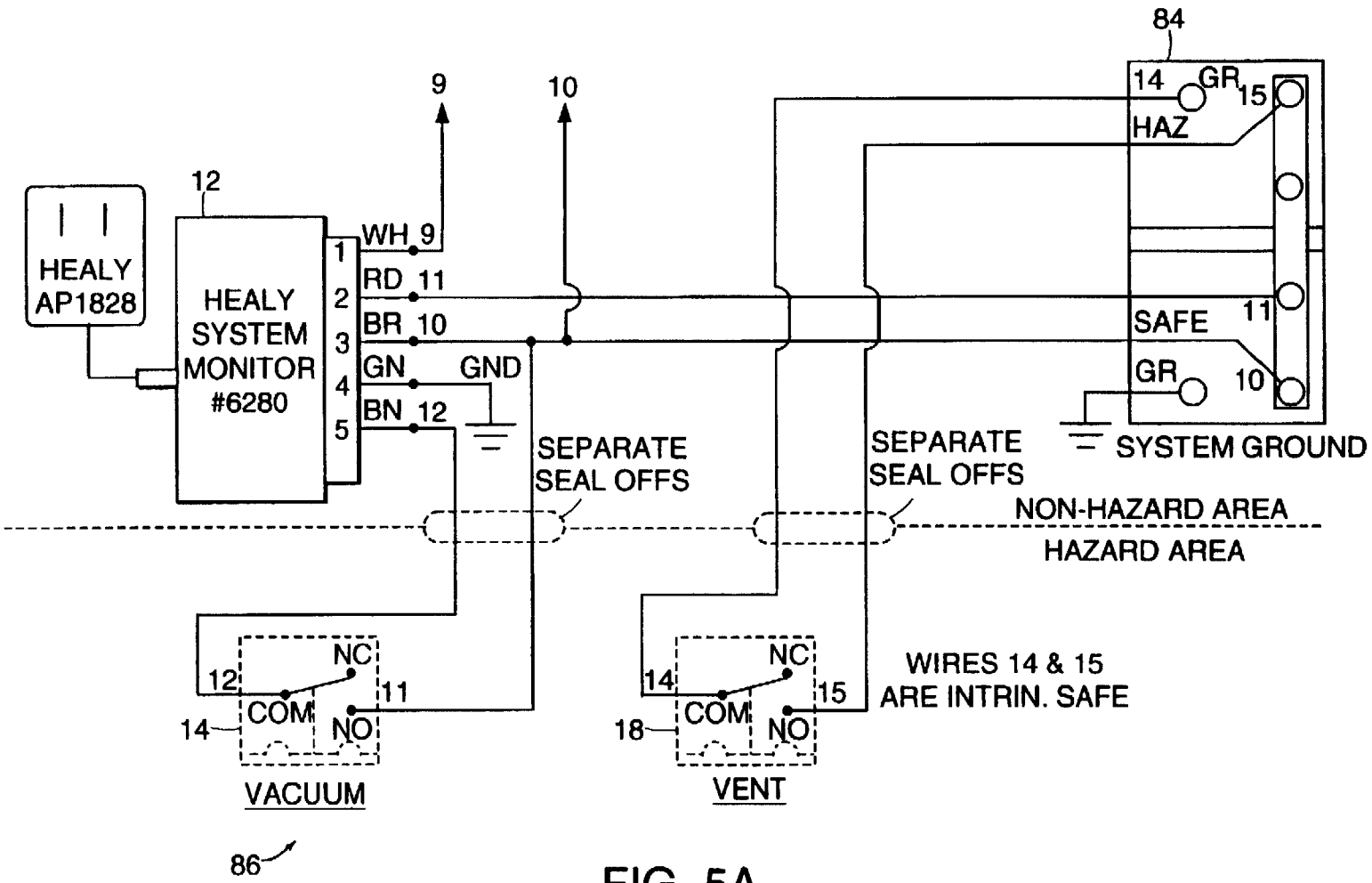
FIG. 5A is a corresponding elementary schematic wiring diagram for optional intrinsically safe wiring.

Referring to FIG. 2, an elementary wiring diagram 20 shows the connections required for electrical indication of vacuum motor operation from signal relay 16 (e.g., a Healy CB-1 signal relay, from Healy Systems, Inc. of Hudson, N.H.) and indication of vacuum level from the pressure-sensing or differential pressure switch 14 (e.g. a Healy 93928 low voltage pressure sensor, also from Healy Systems, Inc.) The "vacuum on" signal relay 16 provides a switch closure when the vacuum source motor (e.g. minijet 22, vane pump 24 or blower 26; FIG. 1) is "on," and the pressure-sensing or differential pressure switch 14 makes a switch closure between wire #11 and wire #12 at the minimum vacuum level (e.g., –65 inches WC). Elementary wiring diagrams for other embodiments of systems of the invention are seen in FIGS. 3, 4 and 5.

When a switch closure occurs between wire #9 and wire #10, the motor run time is accumulated in a first timer 28 of the microprocessor memory 30 of the vapor recovery system monitor 12. This switch closure also starts a second timer 32 to measure the time required to reach the minimum vacuum level, e.g. 10 seconds. If the minimum vacuum level of –65 inches WC is not achieved in 10 seconds (or less) on three consecutive vacuum motor start/stop cycles, a failure is recorded in the vapor recovery system monitor memory for printout 33 at the next scheduled reporting time. Also, a flashing red "LOW" vacuum light 34 is energized at the monitor 12 (FIG. 1) and an audible alarm is sounded to alert the service station attendant.

Instructions for adjusting the various system test parameters are covered below.

The second major area of system monitoring is the vent activity for the underground fuel storage tanks 36 using the vent sensor 18 (e.g., a HEALY 6275 Vent Sensor, from Healy Systems, Inc.).

Figure 6:
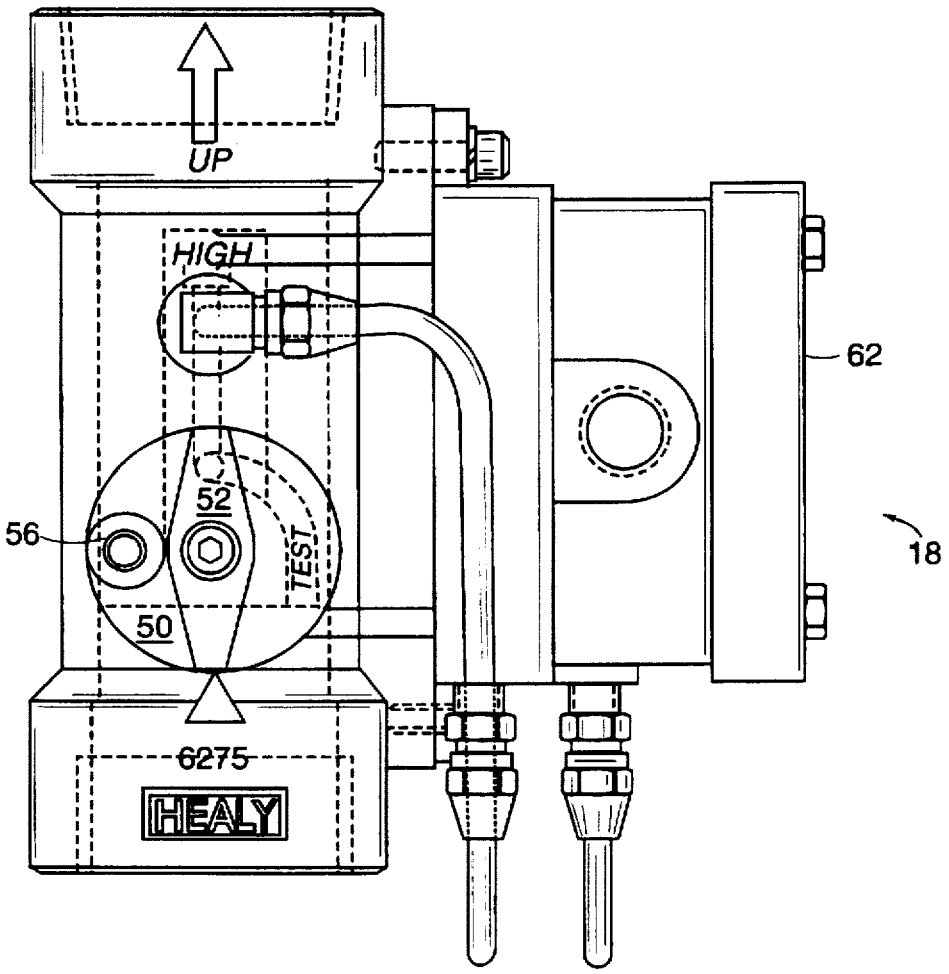
FIG. 6 is a front elevational view of a vent sensor for use in the vapor recovery system monitoring system of the invention.
Figure 7:
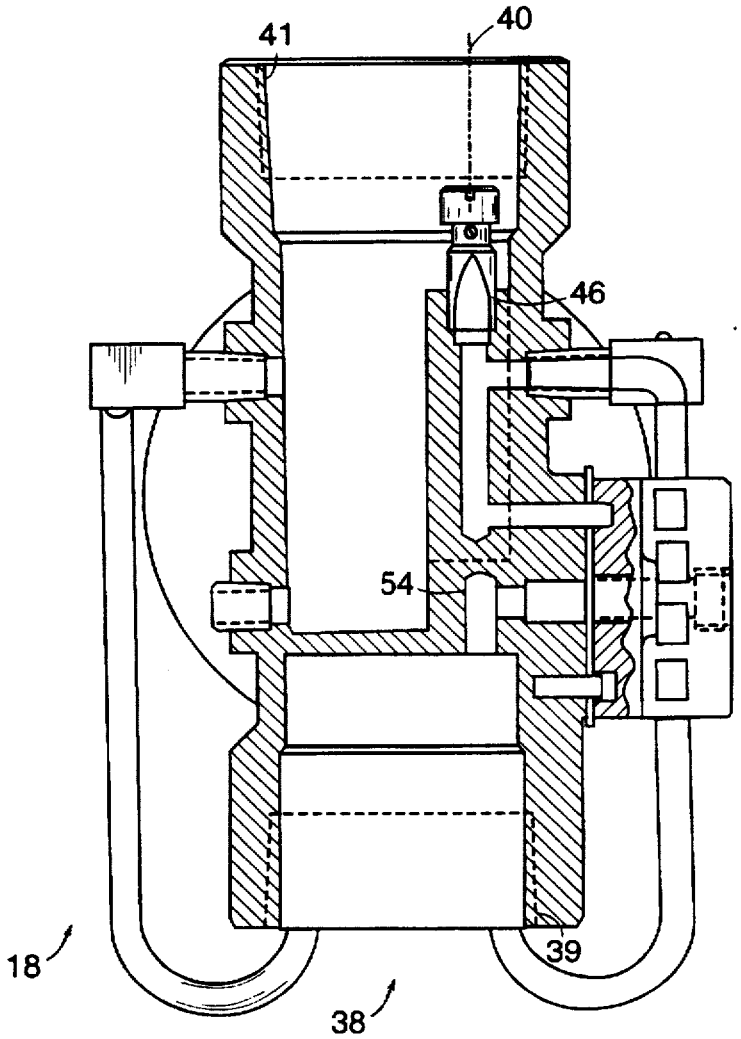
FIG. 7 is a side sectional view of the vent sensor of FIG. 6.

Referring also to FIGS. 6 and 7, the vent sensor 18 is designed to be mounted in a vertical orientation with 2-inch female tapered pipe thread connections 39, 41. The inlet 38 connects to the underground tank vent pipe 42 and the outlet 40 connects to a CARB-certified P/V valve 44. The present CARB ("California Air Resources Board") standard calls for a 3 inch WC (±½ inch) cracking pressure and 8 inch WC (±½ inch) cracking vacuum. Since the vent sensor 18 will only permit a small flow through the measuring orifice 46, a second higher pressure P/V valve 48 (FIG. 1) must be installed in parallel to provide protection for the underground tanks 36. For example, the standards for the second P/V valve 48 are 8 oz. cracking pressure (+14 inches WC) and 8 inches cracking vacuum.

Figure 8:
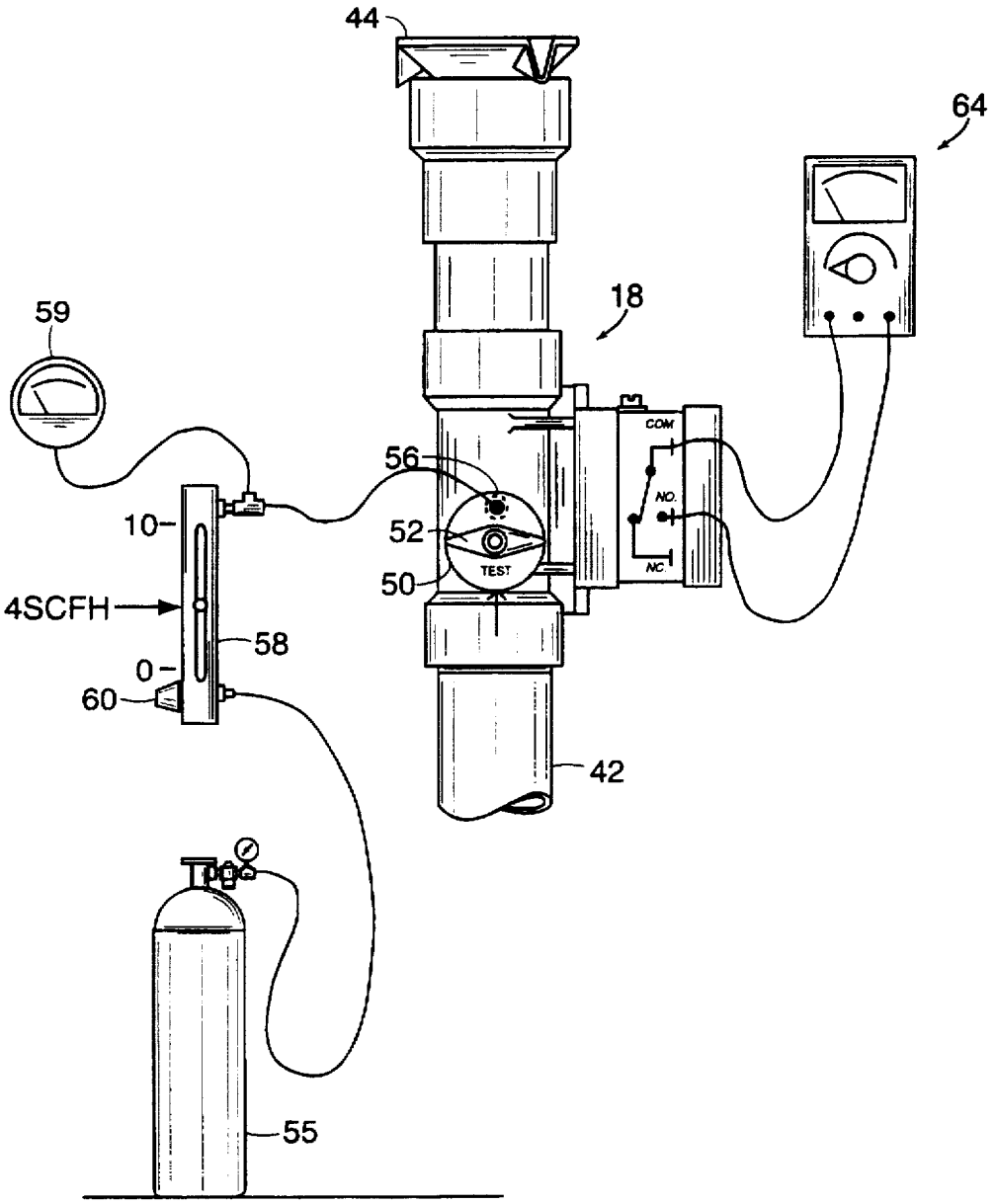
FIG. 8 is a somewhat diagrammatic view of an arrangement for vent sensor calibration in a vapor recovery system monitoring system of the invention.

Referring now also to FIG. 8, calibration of the vent sensor switch point is accomplished by rotating the "TEST" knob 50 by 90° in order to move the operating handle 52 from vertical position (FIG. 6) to horizontal position (FIG. 8). In the horizontal "TEST" position of the knob 50, the port 54 from the underground tanks is blocked off and the ⅛ inch pipe port 56 in the knob 50 is placed in communication with the measuring orifice 46. From supply tank 55, dry nitrogen or air under a pressure equal to the 3 inches cracking pressure of the P/V valve 44 is introduced at the vent sensor test port 56 through a flow meter 58 (e.g., a 0–10 SCFH Model VFB-91 Flow Meter, from Dwyer Instruments, Inc., of Michigan City, Ind.). Manually adjusting the flow meter needle valve 60 to the CARB-specified leak rate (i.e., 4 SCFH or ½ gpm), the service technician can make the set point adjustment on the explosion proof differential pressure switch 62 (e.g. a Series 1959-0 Explosion Proof Differential Pressure Switch, from Dwyer Instruments, Inc.). A differential pressure gauge 59 (e.g., a Magnehelic Differential Pressure Gauge (0–10 inches WC), from Dwyer Instruments, Inc.) may optionally be employed to confirm the proper test flow pressure. The position of the pressure differential switch 62 is monitored with a DC volt meter (0–12 volts) 64.

Figure 9:
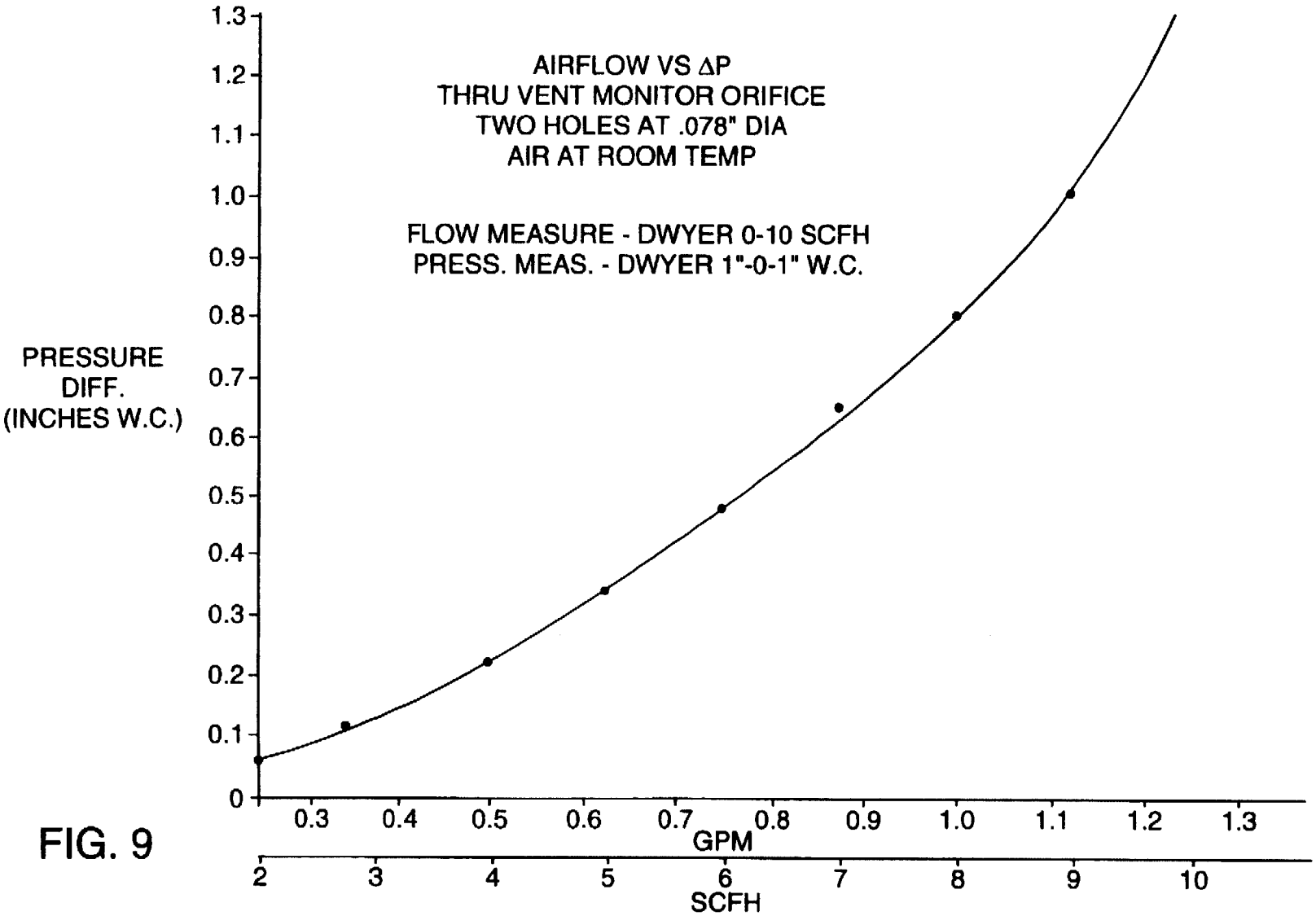
FIG. 9 is a plot of air flow versus change in pressure for accommodation of vent flow ranges by change of measuring orifice diameter.

The air flow range for the measuring orifice 46 on the vent sensor 18 is, e.g., from ¼ gpm to 1 gpm using the pressure differential switch 62. Other vent flow ranges can be easily accommodated by changing the diameter of the measuring orifice 46, e.g. as shown in the "Air Flow Versus ΔP" graph of FIG. 9.

The invention provides a simple, cost effective vapor recovery system monitoring system for detection of the failures outlined above, which cause reductions in vapor recovery efficiency in the gasoline station environment.

The vent sensor 18 employs a simple orifice 46 to create a small pressure differential whenever the volume of vent emissions exceeds ½ gpm. The sensor is mounted in series with a CARB-certified pressure vacuum vent valve 44 to comply with the current California Stage II vapor recovery system regulations. When the vent vapor pressure reaches the P/V valve cracking pressure, vapor flow will be initiated. With a flow of ½ gpm, the pressure differential switch 62 will close, providing continuity between wire #13 and wire #14.

Each time the vent switch 62 closes, the time of venting is accumulated in memory 30. A second memory register 30A also accumulates vent time over a 24-hour period. If the venting time exceeds 10 hours within a 24-hour day on three consecutive days, a failure is recorded in memory for printout 33 at the next scheduled reporting time. Also, a flashing red "EXCESS" venting light 66 is energized at the monitor 12 (FIG. 1), and an audible alarm is sounded to alert the service station attendant. attendant.

The selection of 4 SCFH (½ gpm) as the leak rate is based on a typical service station with gasoline sales of 100,000 gallons per month. The excess venting parameter is set at 10 hours within a 24 hour time frame. Venting of ½ gpm for 10 hours (600 minutes) results in a 300 gallon volume of vent emissions. This represents 10% of the approximately 3,000 gallon daily throughput and, therefore, exceeds the 5% loss allowed by CARB for Stage II vapor recovery systems. Service stations with smaller or larger monthly sales can be provided with a vent sensor adjustment approximating 10% of their specific sales level.

In this manner, the vapor recovery system monitoring system provides the service station owner with timely indication of the need for system maintenance while creating a permanent record of system performance for the responsible environmental enforcement agency.

Operation of the vapor recovery system monitoring system 10 of the invention will now be described, with reference to the drawings.

To close the normally-open contact, solid state relays 68 (e.g. Healy 1005W or Healy #939, from Healy Systems, Inc.) will accept isolated signals from the output side (T2) terminal of each submerged turbine pump motor control relay 70. It is vital that all voltages referred to herein are on the same phase. When the contact 68 closes, voltage is applied simultaneously to the motor control relay for the vacuum source (22, 24, 26) and a small mechanical relay 16 to provide a switch closure signal to the monitor 12 (the amber "MOTOR" light 72 and the flashing red "LOW" light 34 will illuminate). This signal also starts a non-resettable elapsed time recorder 28 that accumulates the total time the vacuum source has been activated. The monitor also provides a DC-sensing circuit across the normally-open contacts of the vacuum differential pressure switch 14, which is set to toggle from normally-open to normally-closed at 65 inch water column (WC) vacuum.

When the vacuum source motor starter coil is energized, the open contact state of the pressure differential switch 14 will cause a "LOW" condition flashing red LED light 34 for as long as the vacuum pressure level is less than –65 inches WC.

The pressure differential switch 14 will close at –65 inches WC, de-energizing the flashing red LED 34 and energizing the green "RUN" LED light 74 and a second elapsed-time meter 32 (non-reset) to record the total accumulated time at vacuum levels in excess of –65 inches WC.

If the vacuum level does not reach –65 inches WC within the specified test period on three consecutive motor starts, an audible alarm and a continuously flashing red LED light 34 will signal a failure. A printed record of this failure, and the number of any additional failures during the test period, will be recorded on the next daily printout 33.

The low vacuum alarm (horn) is driven by the 5 VDC of the main control board 12. The "VACUUM RESET" button 76 will override the audible alarm until the next daily printout occurs.

The second major area of system monitoring is for detecting excessive vent emissions from the underground storage tanks 36. This is the loss of hydrocarbon vapors through the tank vent whenever the ullage space pressure exceeds the +3 inches WC (+½ inch) setting of a CARB-certified pressure vacuum vent valve 44, or at lower pressure, depending on the tightness and reliability of the vent valve.

The vent sensor 18 of the vapor recovery system monitoring system of the invention is a fixed orifice bleed. A differential pressure switch 62 connected across the orifice is set at the CARB-specified leak rate. For example, a flow rate of approximately 0.5 gpm of gasoline vapor will create a differential pressure of 0.4 inch WC, causing switch transfer.

The two-wire connection to the switch on the vent riser is low voltage DC (standard) or intrinsically safe, if required, e.g. a Zener barrier, Model 111950 (from IMO Industries, Inc. of Lawrenceville, N.J.) is UL recognized for this hazardous environment. When vapor flow exceeds the specified leak rate, a switch closure occurs which is detected by the system monitor 12 through the Zener barrier 84 which provides intrinsically safe protection for wires 15, 16. This will energize an amber "VENT" LED light 77 at the monitor 12 (FIG. 1) and a third elapsed-time meter 80 (non-reset) to record the total accumulated time when vent flow is occurring at or above the CARB-specified leak rate. The maximum vent time is preset at the factory at 10 hours. Accumulated vent time of less than 10 hours will automatically reset to "0" every 24 hours. If venting is in excess of ten hours, this event will be recorded. Each consecutive such event will be recorded until three consecutive events result in an audible alarm (horn) and a flashing red "EXCESS" LED light 66. Any 24-hour period with less than 10 hours of venting after the first or second event will cause the count to be reset to "0". The vent "RESET" button 78 will override the audible alarm until the next daily printout occurs. The next printout 33 will include a record of the vent failure and will cause the event counter to reset to "O".

The field reporting procedure consists of daily printouts 33 from the system monitor 12. These printouts include all operating parameters including operating time and percentages for all the important data. The "PRINT DATA" button 82 is used to generate a current status report of the daily printout, information as shown in the following sample report.

Healy Systems Monitor Report
(Customer Name and Address)
Date: 11/01/95
Time: 12:28

VACUUM INFORMATION

System Time

| Days | Hours | Minutes | % |
|---|---|---|---|
| 0142 | 00 | 48 | 100.00 |

Vacuum Motor Time

| Days | Hours | Minutes | % (Sys. Time) |
|---|---|---|---|
| 0056 | 08 | 50 | 39.67 |

Run Time

| Days | Hours | Minutes | % (Motor Time) |
|---|---|---|---|
| 0050 | 23 | 20 | 90.43 |

VENTING INFORMATION

Vent Test Period

| Days | Hours | Minutes |
|---|---|---|
| 0000 | 24 | 00 |

Vent Alarm Period

| Days | Hours | Minutes |
|---|---|---|
| 0000 | 10 | 00 |

Accumulated Vent Time

| Days | Hours | Minutes | % (Alarm Period) |
|---|---|---|---|
| 0000 | 08 | 37 | 86.1 |

Total Accumulated Vent Time

| Days | Hours | Minutes |
|---|---|---|
| 0000 | 12 | 22 |

PARAMETER INFORMATION

| | |
|---|---|
| Vent Test Period | 0024 (Hours) |
| Max. Errors Before Alarm | 0003 |
| Max. Run Startup Time | 0010 (Seconds) |
| Max. Errors Before Alarm | 0003 |

FAILURE INFORMATION

Low Vacuum Failure at 14:48 (or NO FAILURE TODAY)

A failure history report showing the type of failure, date and time can be printed out by simultaneously pressing both "RESET" buttons 76, 78. The report will show the last 10 failures as shown in the following sample.

FAILURE HISTORY REPORT

Low vacuum failure at 14;48 on Nov. 1, 1995.
Excess vent failure at 14:48 n Oct. 24, 1995.
Low vacuum failure at 14:48 on Oct. 20, 1995.
Excess vent failure at 14:28 on Oct. 12, 1995.
Low vacuum failure at 14:32 on Sep. 2, 1995.
Excess vent failure at 14:41 on Aug. 18, 1995.
Low vacuum failure at 14:42 on Aug. 15, 1995.
Excess vent failure at 14:43 on Aug. 12, 1995.
Excess vent failure at 14:41 on Aug. 9, 1995.
Excess vent failure at 14:44 on Aug. 6, 1995.

Figure 10:
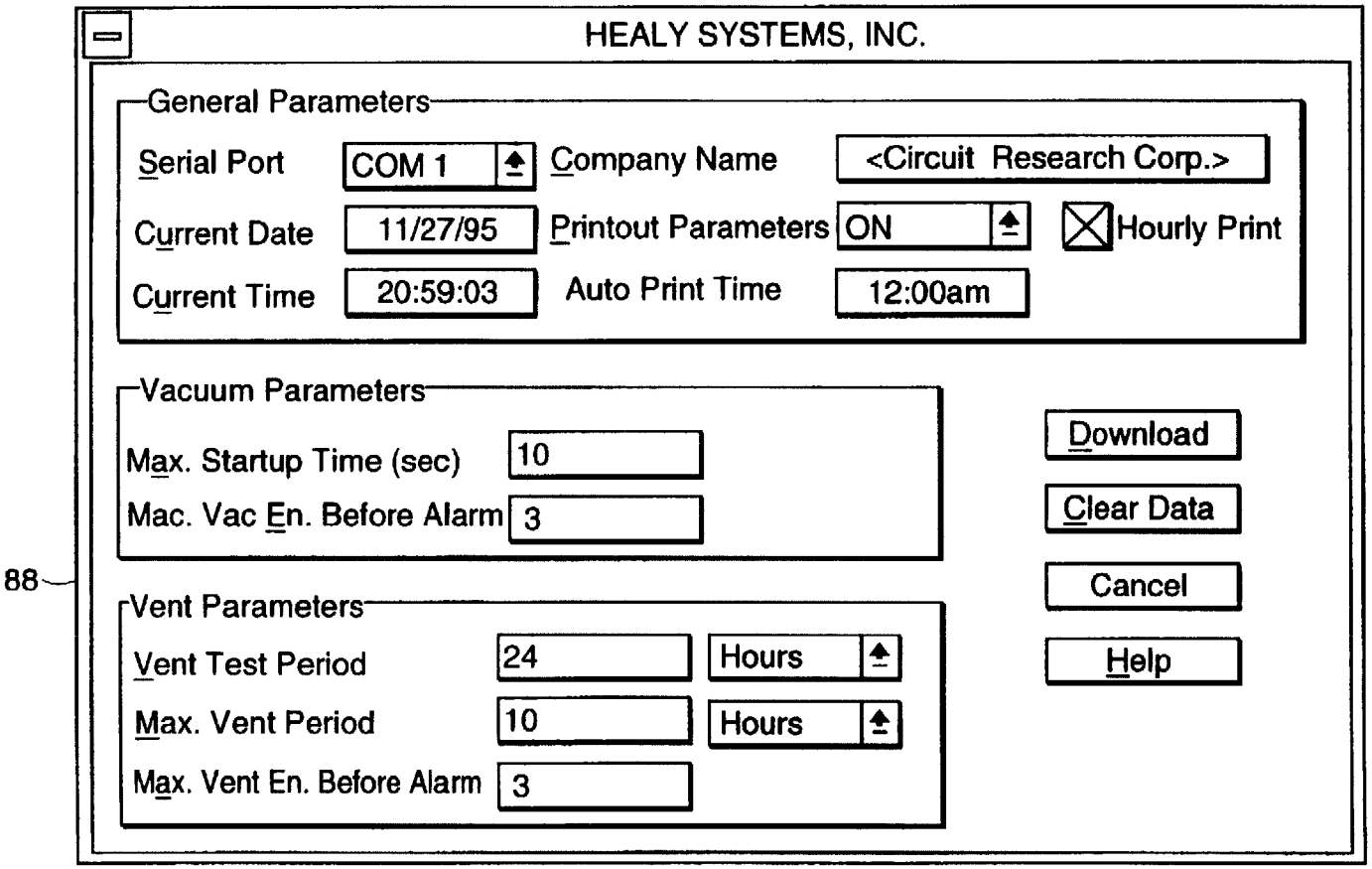
FIG. 10 is a representation of a computer dialog box for establishing parameters during set-up of a vapor recovery system monitoring system of the invention.

The monitoring parameters, as listed below and shown on the sample display 88 (FIG. 10) can be customized for each individual application using a support program. The download parameters and their effect on the vapor recovery system monitoring system of the invention are as follows:

| | |
|---|---|
| Serial Port | The following are valid selections: COM1, COM2, COM3 or COM4. |
| Company Name | Put the name of the system user in this field. Only 40 characters are allowed. When a print out as made from the monitor 12, the service station name will be displayed at the top of the printout 33. |
| Date | The data held cannot be changed. This value is read from the computer clock and is passed down to the monitor control board so the control board has the current date. |
| Time | The time field cannot be changed. This value is read from the computer clock and is passed down to the monitor control board so the control board has the current date. |
| Printout Parameters | This control turns printing "ON" or "OFF" for the described parameters. |
| Hourly Print | This parameter is set to "ON" for system problem diagnosis. It will provide information regarding hour by hour changes. It should be set to the "OFF" condition for normal monitoring. |
| VACUUM PARAMETERS | |
| Maximum Start-Up Time (Seconds) | The time allowed for the vacuum to reach a normal level. This value can not be exceeded more than "Maximum Errors Before Alarm" consecutive times. If it does, an audible alarm sounds. For example, if the "Maximum Start-Up Time" equals 10 seconds and the "Maximum Errors Before Alarm" equals 3, and if the vacuum does not reach a normal level on three consecutive vacuum pump start/stop cycles, the audible alarm sounds. The following are valid selections: 1–59 seconds. |
| Maximum Errors Before Alarm | This is how many times the "Maximum Start Up Time" or the "Maximum Vent Period" can be reached before sounding an alarm. There is no limit on the entered value. |
| VENT PARAMETERS | |
| Vent Test Period | This is the time period that venting is monitored. If the "Maximum Vent Period" value is exceeded during this time period, the audible alarm sounds. The following are valid selections: 0 minutes to 999 hours. |
| Maximum Vent Period | This is the time period that can not be exceeded during the "Vent Test Period". For example, if the "Vent Test Period" is set to 24 hours and the "Maximum Vent Period" is set to 10 hours, then during a 24-hour period the system is not allowed to vent for more than 10 hours. If it does this on three consecutive vent test periods, the audible alarm will sound. The following are valid selections: any time period less than the "Vent Test Period". |
| Button Descriptions: | |
| Download | The monitor 12 must be cabled to the PC. When the "DOWNLOAD" button is clicked, all the parameters described in this section are transferred to the monitor system 10. This allows the parameters to be customized for each customer. |
| Clear Data | This will bring up a new screen requiring password access to clear all system history and timers. This function is for factory use only. |
| Cancel | This will cause the "Download Parameters" dialog box to be released and no |

-continued

| | |
|---|---|
| | parameters will be transferred to the monitor. |
| Help | "Help" loads the "Help" file for the monitor. |

Other embodiments are within the following claims.

For example, if more precise data are required, the system may employ a pressure differential transmitter (e.g., a Dwyer Model 603A-12 pressure transmitter, from Dwyer Instruments, Inc.) in place of the single set point flow switch(es). The output signal from the transmitter would indicate the vapor flow rate and, using the timing features and math powers of the microprocessor, the printout would show volume of flow as well as average flow rate.

Referring to FIG. 1, for direct burial cable applications, an intrinsically safe Zener barrier 84 (e.g. HEALY Part No. 6299 Intrinsically Safe Assembly, from Healy Systems, Inc.) may be provided, with wiring 86 as shown, e.g., in FIGS. 2A, 3A, 4A and 5A.

Also, in order to detect the ingestion of air through the vent into the underground tank system 36, a second switch closure resulting from an orifice pressure differential in the opposite direction may be provided. Rising barometric pressure or vapor/liquid ratios set too low could cause this type of system failure. The same "EXCESS" venting flashing light 66 and audible alarm sounding would occur; however, the report 33 would indicate air inflow excess. Two additional wires to the vent sensor 18 would be required to provide this capability.

What is claimed is:

1. A vapor recovery system monitoring system comprising:

a vacuum monitoring assembly comprising a vacuum source signal relay adapted to be in communication with a vacuum system served by a vacuum source and adapted to generate a first vacuum signal upon actuation of the vacuum source for recovery of displaced fuel vapor and a second vacuum signal when a predetermined minimum vacuum level is achieved in the vacuum system;

a timer for measuring the elapsed time between said first vacuum signal and said second vacuum signal;

a vacuum comparator for comparing the elapsed time with a predetermined standard; and a vacuum signal device for display of a vacuum error message after a predetermined number of instances of elapsed time exceeding the predetermined standard; and a vent sensor assembly comprising:

a vent sensor adapted to be mounted to a vent conduit for an underground storage tank, said vent sensor defining an orifice adapted to create a pressure differential when volume flow of vent emissions exceeds a predetermined level;

a pressure differential switch;

a counter adapted to receive a venting signal from said pressure differential switch for providing indication of venting frequency over a predetermined period of time;

a timer adapted to receive a venting signal from said pressure differential switch for providing indication of total venting time over a predetermined period of time;

a venting comparator for comparing the total venting time with a predetermined acceptable total venting time; and a venting signal device for display of a venting error message when a predetermined acceptable total venting time is exceeded.

2. The vapor recovery system monitoring system of claim 1 wherein said predetermined minimum vacuum level for issue of said second vacuum signal is about −65 inches WC.

3. The vapor recovery system monitoring system of claim 1 wherein said vacuum signal device is adapted to display the vacuum error message after a predetermined number of consecutive instances of elapsed time exceeding the predetermined standard.

4. The vapor recovery system monitoring system of claim 3 wherein said vacuum signal device is adapted to display the vacuum error message after three consecutive instances of elapsed time exceeding the predetermined standard.

5. The vapor recovery system monitoring system of claim 1 wherein said predetermined standard is ten seconds.

6. The vapor recovery system monitoring system of claim 1 wherein said vacuum error message is a flashing signal light.

7. The vapor recovery system monitoring system of claim 1 or 6 wherein said vacuum error message is an audible signal.

8. The vapor recovery system monitoring system of claim 1 wherein said predetermined level of volume flow of vent emissions is about 0.5 gpm (gallons per minute).

9. The vapor recovery system monitoring system of claim 1 wherein said venting signal device is adapted to display the venting error message after a predetermined number of consecutive days of total venting time exceeding the predetermined acceptable total venting time.

10. The vapor recovery system monitoring system of claim 9 wherein said venting signal device is adapted to display the venting error message after three consecutive days of total venting time exceeding the predetermined acceptable total venting time.

11. The vapor recovery system monitoring system of claim 10 wherein said predetermined acceptable total venting time is ten hours in a twenty-four hour period.

12. The vapor recovery system monitoring system of claim 1 wherein said venting error message is a flashing signal light.

13. The vapor recovery system monitoring system of claim 1 or 12 wherein said venting error message is an audible signal.

14. The vapor recovery system monitoring system of claim 1 further comprising a second vent sensor adapted to be mounted to a vent conduit for an underground storage tank for detection of ingestion of air into the storage tank, said second vent sensor defining an orifice to create a pressure differential whenever vent ingestion volume exceeds a predetermined level, said second vent sensor comprising:

a second pressure differential switch;

a counter adapted to receive a vent ingestion signal from said second pressure differential switch for providing indication of vent ingestion frequency over a predetermined period of time;

a timer adapted to receive a vent ingestion signal from said second pressure differential switch for providing indication of total vent ingestion time over a predetermined period of time;

a vent ingestion comparator for comparing the total vent ingestion time with a predetermined acceptable total vent ingestion time; and a vent ingestion signal device for display of a vent ingestion error message when a predetermined acceptable total vent ingestion time is exceeded.

15. The vapor recovery system monitoring system of claim 14 wherein said vent ingestion signal device is adapted to display the vent ingestion error message after a predetermined number of consecutive days of total vent ingestion time exceeding the predetermined acceptable total vent ingestion time.

16. The vapor recovery system monitoring system of claim 15 wherein said vent ingestion signal device is adapted to display the vent ingestion error message after three consecutive days of total vent ingestion time exceeding the predetermined acceptable total vent ingestion time.

17. The vapor recovery system monitoring system of claim 16 wherein said predetermined acceptable total vent ingestion time is ten hours in a twenty-four hour period.

18. The vapor recovery system monitoring system of claim 14 wherein said vent ingestion error message is a flashing signal light.

19. The vapor recovery system monitoring system of claim 14 or 18 wherein said vent ingestion error message is an audible signal.

20. The vapor recovery system monitoring system of claim 1 or 14 wherein said vent monitor assembly further comprises a higher pressure P/V valve mounted in parallel.

21. The vapor recovery system monitoring system of claim 1 further comprising a recording device for creating a permanent record of performance.

22. The vapor recovery system monitoring system of claim 1 or 14 wherein said vent sensor assembly comprises a pressure differential transmitter for calculation of vented volume.

23. The vapor recovery system monitoring system of claim 14 wherein said vent sensor assembly comprises a pressure differential transmitter for calculation of ingested volume.

24. A method for monitoring a vapor recovery system, said method comprising the steps of:

providing a vacuum monitoring assembly comprising a vacuum source signal device in communication with a vacuum system served by a vacuum source;

causing the vacuum source signal device to generate a first vacuum signal upon actuation of the vacuum source for recovery of displaced fuel vapor;

causing the vacuum source signal device to generate a second vacuum signal when a predetermined minimum vacuum level is achieved in the vacuum system;

measuring the elapsed time between the first vacuum signal and the second vacuum signal;

comparing the elapsed time with a predetermined standard; and generating a vacuum error message after a predetermined number of instances of elapsed time exceeding the predetermined standard;

providing a vent sensor assembly comprising a vent sensor in communication with a vent conduit from an underground storage tank, the vent sensor defining an orifice adapted to create a pressure differential when volume flow of vent emission exceeds a predetermined level, and a pressure differential sensor;

causing the pressure differential sensor to issue a venting signal to a counter for providing indication of venting frequency over a predetermined period of time;

causing the pressure differential sensor to issue a venting signal to a timer providing indication of total venting time over a predetermined period of time;

comparing the total venting time with a predetermined acceptable total venting time; and generating a venting error message when a predetermined acceptable total venting time is exceeded.

25. The method for monitoring a vapor recovery system of claim 24, said method comprising the further step of generating the vacuum error message after a predetermined number of consecutive instances of elapsed time exceeding the predetermined standard.

26. The method for monitoring a vapor recovery system of claim 25, said method comprising generating the vacuum error message after three consecutive instances of elapsed time exceeding the predetermined standard.

27. The method for monitoring a vapor recovery system of claim 24, said method comprising the further step of generating the venting error message after a predetermined number of consecutive days of total venting time exceeding the predetermined acceptable total venting time.

28. The method for monitoring a vapor recovery system of claim 27, said method comprising generating the venting error message after three consecutive days of total venting time exceeding the predetermined acceptable total venting time.

29. The method for monitoring a vapor recovery system of claim 24, said method comprising the further step of providing a second vent sensor in communication with a vent conduit for an underground storage tank for detection of ingestion of air into the storage tank, the second vent sensor defining an orifice to create a pressure differential whenever vent ingestion volume exceeds a predetermined level, and a second pressure differential sensor;

causing the second pressure differential sensor to issue a vent ingestion signal to a counter for providing indication of vent ingestion frequency over a predetermined period of time;

causing the second pressure differential switch to issue a vent ingestion signal to a timer for providing indication of total vent ingestion time over a predetermined period of time;

comparing the total vent ingestion time with a predetermined acceptable total vent ingestion time; and generating a vent ingestion error message when a predetermined acceptable total vent ingestion time is exceeded.

30. The method for monitoring a vapor recovery system of claim 29, said method comprising the further step of generating the vent ingestion error message after a predetermined number of consecutive days of total vent ingestion time exceeding the predetermined acceptable total vent ingestion time.

31. The method for monitoring a vapor recovery system of claim 30, said method comprising generating the vent ingestion error message after three consecutive days of total vent ingestion time exceeding the predetermined acceptable total vent ingestion time.

32. The method for monitoring a vapor recovery system of claim 24, said method comprising the further step of creating a permanent record of performance.

33. The method for monitoring a vapor recovery system of claim 24, said method comprising the further step of calculating vented volume.

34. The method for monitoring a vapor recovery system of claim 24, said method comprising the further step of calculating ingested volume.

35. A vapor recovery system monitoring system comprising:

a vacuum monitoring assembly comprising a vacuum source monitor for a vacuum system served by a vacuum source, for generating a first vacuum signal upon actuation of the vacuum source for recovery of displaced fuel vapor and a second vacuum signal when a predetermined minimum vacuum level is achieved in the vacuum system;

a timer for measuring the elapsed time between said first vacuum signal and said second vacuum signal;

vacuum comparator means for comparing the elapsed time with a predetermined standard; and a vacuum signal device for initiating a vacuum error message after a predetermined number of instances of elapsed time exceeding the predetermined standard; and a vent sensor assembly comprising:

a vent sensor adapted to be mounted in communication with a vent conduit for an underground storage tank, said vent sensor defining an orifice creating a pressure differential when volume flow of vent emissions exceeds a predetermined level;

a pressure differential sensor;

a counter receiving a venting signal from said pressure differential sensor for providing indication of venting frequency over a predetermined period of time;

a timer receiving a venting signal from said pressure differential sensor for providing indication of total venting time over a predetermined period of time;

a venting comparator means for comparing the total venting time with a predetermined acceptable total venting time; and a venting signal device for initiating a venting error message when a predetermined acceptable total venting time is exceeded.

36. The vapor recovery system monitoring system of claim 35 further comprising a second vent sensor adapted to be in communication with a vent conduit for an underground storage tank for detection of ingestion of air into the storage tank, said second vent sensor defining an orifice to create a pressure differential whenever vent ingestion volume exceeds a predetermined level, said second vent sensor comprising:

a second pressure differential sensor;

a counter receiving a vent ingestion signal from said second pressure differential sensor for providing indication of vent ingestion frequency over a predetermined period of time;

a timer receiving a vent ingestion signal from said second pressure differential sensor for providing indication of total vent ingestion time over a predetermined period of time;

a vent ingestion comparator means for comparing the total vent ingestion time with a predetermined acceptable total vent ingestion time; and a vent ingestion signal device for initiating a vent ingestion error message when a predetermined acceptable total vent ingestion time is exceeded.

* * * * *